United States Patent [19]

Stevens

[11] 4,147,246

[45] Apr. 3, 1979

[54] ANTI-THEFT PARKING SYSTEM

[76] Inventor: Robert L. Stevens, P.O. Box 2082, Framingham, Mass. 01701

[21] Appl. No.: 844,887

[22] Filed: Oct. 25, 1977

[51] Int. Cl.[2] ..... G07F 15/10

[52] U.S. Cl. ..... 194/9 T

[58] Field of Search ..... 194/DIG. 21, DIG. 22, 194/DIG. 23, 9 T, 97

[56] References Cited

U.S. PATENT DOCUMENTS 1,965,066 7/1934 Babson ..... 194/DIG. 22

*Primary Examiner*—Stanley H. Tollberg

*Attorney, Agent, or Firm*—Dike, Bronstein, Roberts, Cushman & Pfund

[57] ABSTRACT

An anti-theft parking system comprising a free-standing post at each delineated area for the parking of a single vehicle supporting audible and illuminated signals and a control circuit so designed that when a vehicle is driven into the area so as to depress a road switch set into the pavement of the area and a coin of appropriate value is deposited in a coin box, a key may be removed from a key switch without actuating the alarms, but if the vehicle is removed from the parking area so as to release the ground switch without restoring the key, the alarms will be actuated. There is a panel which becomes illuminated by parking the vehicle which indicates that a coin should be inserted and a panel which becomes illuminated by removal of the key which indicates that the system is conditioned for operation.

9 Claims, 5 Drawing Figures

ANTI-THEFT PARKING SYSTEM

BACKGROUND OF INVENTION

Vehicle-actuated devices located in vehicle parking areas for preventing unauthorized removal and/or producing an alarm when removed without authorization are known in the art. For example, Selby U.S. Pat. No. 3,757,916 shows barrier plates which are moved into position behind the front wheel of a vehicle when the latter is parked within a given parking area to prevent the vehicle from being removed until the correct parking fee has been deposited. U.S. Pat. No. 3,986,591 shows a hood which is automatically raised beneath the vehicle when the vehicle is parked in a predetermined parking area to a position of engagement with the underside of the vehicle such as to prevent the vehicle from being removed without first depositing the correct parking fee. Waldman U.S. Pat. No. 2,815,842 shows a device which must be attached by the driver to the vehicle at the time of parking to start the meter and which, when detached, resets the meter to a zero position. Cherico U.S. Pat. No. 3,824,536 shows a wheel block adapted to be placed in blocking engagement with a wheel which is operable if the wheel is moved away from it to produce an alarm. U.S. Pat. Nos. 3,781,861; 3,824,540 and 3,866,205 show various kinds of bicycle locks and alarms which are operated if an attempt is made to remove the lock. The anti-theft system of this invention, unlike the aforesaid patents, is not designed to physically constrain the vehicle, but, on the contrary, is designed to produce a visual and/or audible system with minimal circuitry, the latter being so designed that the system itself cannot be actuated in the absence of a parked vehicle.

SUMMARY OF THE INVENTION

In a designated parking area, an alarm system including an alarm circuit comprising a vehicle-actuatable switch, a coin-operated switch and a key-operated switch and circuitry comprising means operable by the activation of the vehicle actuatable switch to precondition the coin-operated switch for operation, means operable by the deposit of a coin in the coin-operable switch to release the key from the key-operable switch, alarm means, means operable by the removal of the key from the coin-operable switch to place the alarm means in a ready state, and means operable by deactivation of the vehicle-actuatable switch in the absence of the key to effect actuation of the alarm means. There is an "Insert Coin" light which is illuminated by activation of the vehicle-actuatable switch when parking the vehicle to indicate that the system is receptive to operation and an "Alarm Activated" light illuminated by removal of the key from the key-operated switch indicating that the system is in a ready condition. Removal of the key in addition to illuminating the "Alarm Activated" light extinguishes the "Insert Coin" light. The alarm means comprises visible and audible components.

The invention will now be described with reference to the accompanying drawings, wherein.

Figure 1:
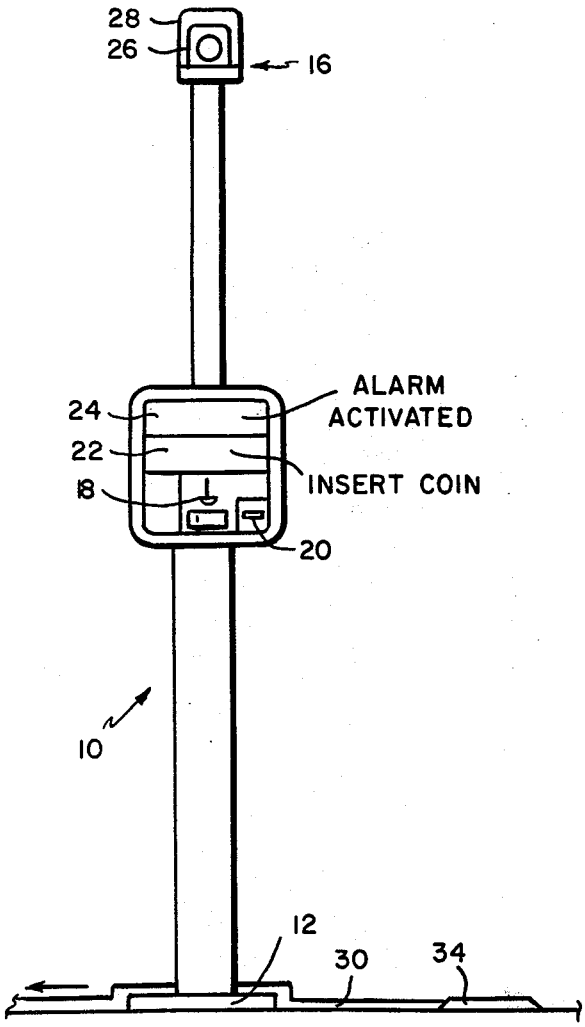
FIG. 1 is a front elevation of the anti-theft parking device.
Figure 2:
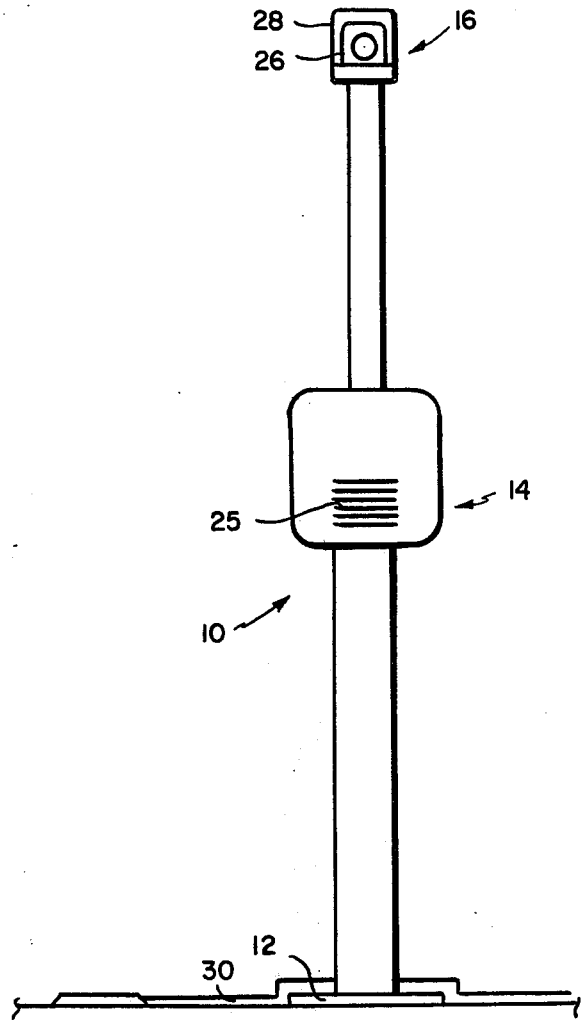
FIG. 2 is a rear elevation of FIG. 1.

The alarm system herein illustrated is designed to be used within authorized parking areas, one to be used in conjunction with each area, in place, for example, of the conventional money meter and, as illustrated in FIGS. 1 and 2, somewhat diagrammatically, comprises a free-standing post 10 fixed at its lower end to a footing plate 12 which is either bolted to or embedded in the paving of the road or adjacent sidewalk which mounts intermediate its lower and upper ends. A control box 14 is mounted on the post at a correct height for ease of manipulation which houses the operating circuitry and which has on its face instructions for its use. At the top of the post there is a beacon light 16 which, in conjunction with an audible alarm in the box 14, provides a warning that there has been an unauthorized removal of the car parked in that area.

As shown in FIG. 1, the face of the box is provided with a coin slot 18 for receiving a coin, a numbered key 20 which is adapted to be removed when the vehicle is parked and replaced when the owner of the vehicle removes the car, an indicator 22 comprises a colored translucent panel which is lighted up when the vehicle is moved into the parking position to display the words "Insert Coin", thus indicating that the system is in a receptive condition and an indicator 24 which comprises a colored translucent panel which lights up when the coin has been deposited and the key removed to display the words "Alarm Activated," indicating that the system is in a ready condition for sounding an alarm in the event that the vehicle is removed without restoring the key. At the back side of the box 14, there are a plurality of openings 25 in the form of slots through which the audible alarm housed within the box will be braodcast.

The beacon 16 at the top of the post comprises a flashing red light 26 housed within a wire mesh guard 28 attached to the top of the post.

Suitable wiring 30 at the foot of the post connects the circuitry to a source of power and wiring 32 connects the circuitry to a road switch 34 which is adapted to be actuated by pressure of the front wheel of the vehicle when the latter is moved into the parking position and to be held depressed thereby as long as the vehicle is parked. A photoelectric switch or proximity switch may be used in lieu of the road switch.

Figure 3:
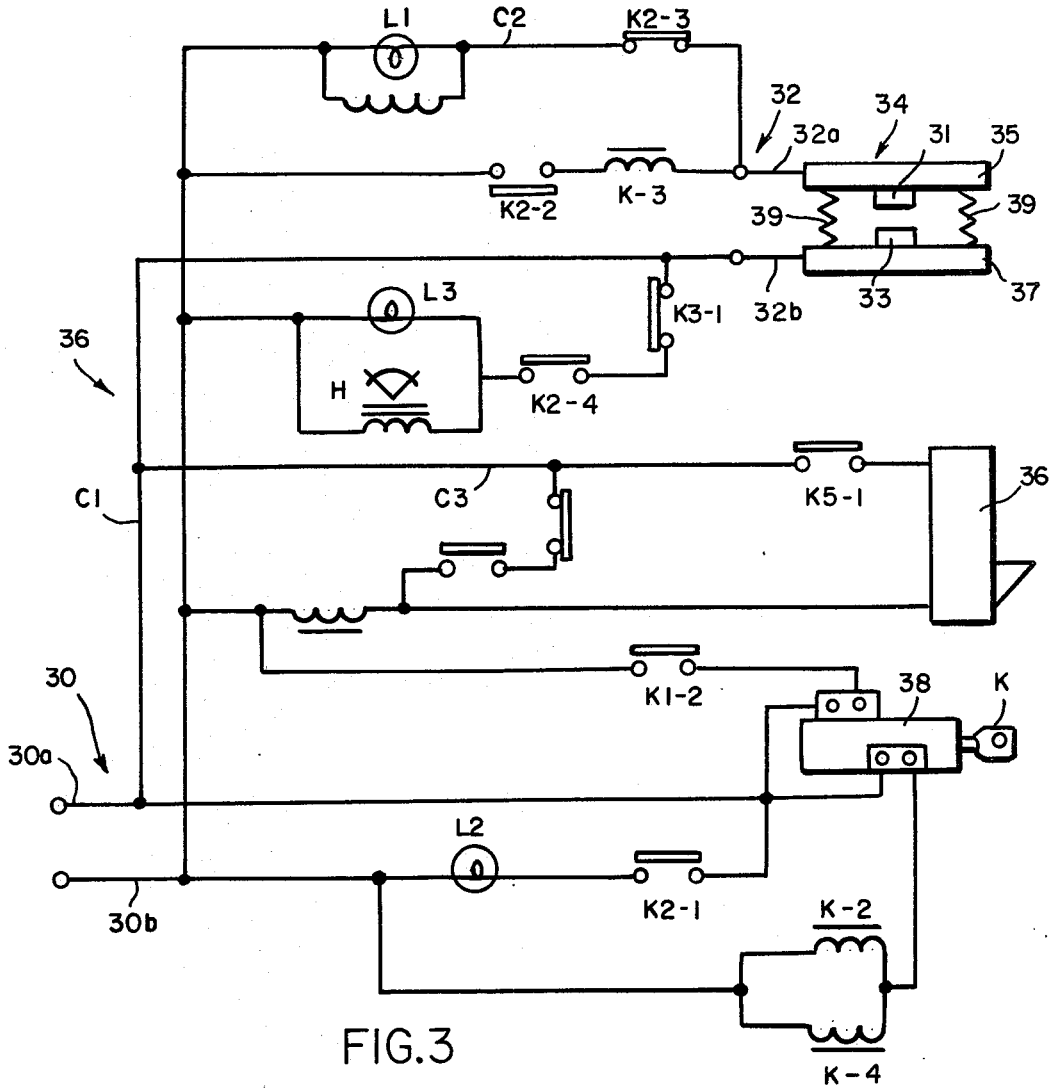
FIG. 3 is an overall wiring diagram of the circuitry which controls the operation of the alarm means.
Figure 4:
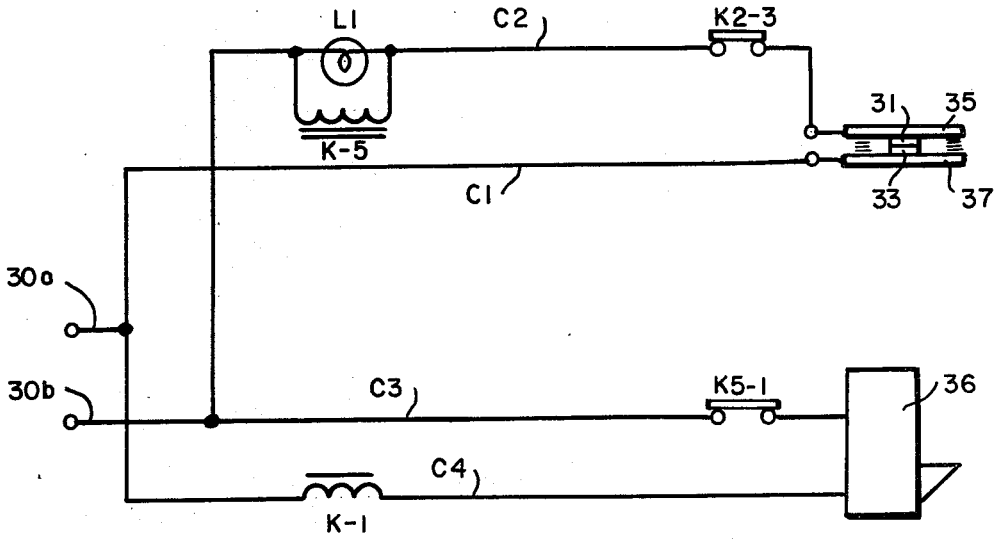
FIG. 4 is a partial wiring diagram showing the circuitry established by the initial depression of the road switch.

Referring to FIG. 3, the circuitry 36 is connected to the source of power by wiring 30 comprising conductors 30*a* and 30*b* and to the road switch by the wiring 32 which comprises conductors 32*a* and 32*b*. The road switch 36 comprises contacts 31 and 33 mounted between spaced plates 35,37 set into a recess in the pavement so that upper plate 35 is held separated from the plate 37 by spring means 39—39 so that the plate 35 is slightly above the surface of the pavement. When a vehicle is driven into the parking area so that a front wheel of the vehicle depresses the plate 35 sufficiently to engage the contact 31 with the contact 33, a circuit is established through conductor 30*a*, conductor C1, contact 33, contact 31, normally closed contacts K2-3, and conductor C2, to conductor 30*b* as shown in FIG. 4. In this circuit, there is a relay K-5 and a lamp L1. A conductor C3 connects a normally closed switch K5-1 to one side of the input 30b and to switch means in a coin box 36. The other side of the switch means in the coin box is connected by a conductor C4 containing a relay K-1 with the other side 30a of the input. Depressing and closing the road switch 36 thus energizes the relay K-5, illuminates the lamp L1 and energizes the relay K-1. The lamp L1, when illuminated, lights up the panel 22, thus serving notice to the person using the device that it is in working order ready to receive a coin of the required denomination. The energization of the relay K-5 closes the normally open switch K5-1, thus conditioning the switch means in the coin box 36 for reception of the coin.

Figure 5:
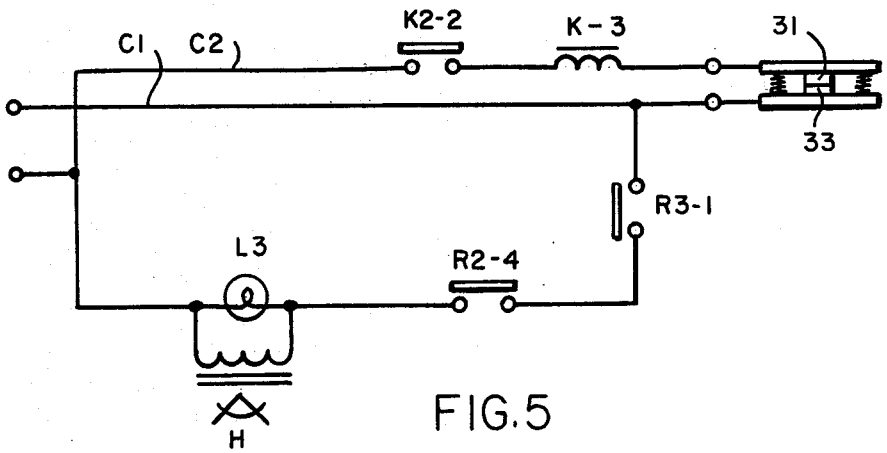
FIG. 5 is a partial wiring diagram showing the circuitry established which readies the alarm means for operation.

With the knowledge that the system is in coin-receptive condition, the operator drops a coin of the required denomination into the coin box 36, the effect of which, either through establishing a flow of current through the coin itself or through contacts closed by the weight of the coin, is to complete a circuit through relay K-1, energizing relay K-1 which, in turn, closes a normally open switch K1-2, FIG. 3, to the switch means in a key-operated switch 38. Completion of the circuit to the key-operated switch permits the key K to be withdrawn from the key-operated switch and, when the latter is withdrawn, it effects energization of two relays K-2 and K-4. Energization of relay K-2 closes normally open switch K2-1 which supplies energy to illuminate a lamp L2 which lights up the panel 24 as previously referred to which bears the legend "Alarm Activated" indicating the the alarm means is set and will give off an alarm if the vehicle is removed in an unauthorized manner. The energization of relay K-2 also closes the normally open switch K2-2 and opens the normally closed switch K2-3. Energization of the relay K-4 opens the normally closed switch K4-1. When the key is removed from the key latch, the alarm means which comprises a lamp L3 and an electrically operated bell or horn H is readied for operation by way of the closed switch K2-4 which, as indicated, was closed by the relay K-4, but for the closing of normally closed switch K3-1 which was opened by closing of the road switch and energization of the relay K-3, FIG. 5. If now the road switch is released without restoring the key into the key latch, the relay K-3 is deenergized, whereupon the contacts K3-1 close, and since the contacts K2-4 have been previously closed, both alarms L3 and H are actuated simultaneously.

While the vehicle is parked and thus holds the road switch depressed, the removal of the key operates to deactivate the "Insert Coin" light and the relay K-5 by opening the contact K2-3. Deenergization of relay K-5 also opens the contacts K5-1 to the coin switch means. Thus, during the time that the vehicle is in place, the "Insert Coin" light L1 and the coin switch means are deactivated. When the key is restored to the coin box, relays K-2 and K-4 become deenergized, thus opening the switch K2-4 and closing the switch K4-1 which, respectively, disable the alarm means and enable the means for locking the key within the key-operated switch means in the coin box. The deenergization of the relay K-5, because it opens the contact K5-1, prevents operation of the system by placing a coin in the coin box in the absence of a parked vehicle.

In operation, a person wishing to use the device for parking with the assurance that unauthorized removal of the vehicle will be accompanied by a significant alarm, both audible and visible, drives the vehicle to a position in which the front wheel depresses the upper plate 35 of the road switch and, then, after alighting from the vehicle, places a coin of suitable denomination in the coin box and removes the key from the key-operated switch. Having followed this procedure, the vehicle cannot be removed in the absence of restoring the key into the key latch without operation of the alarm. Upon returning for removing his vehicle, the operator must replace the key in the key latch.

The device is safe from tampering when a vehicle is not parked by the reason that the coin circuit is disabled and that disabling of the coin switch disables the means for releasing the key from the key latch.

It should be understood that the present disclosure is for the purpose of illustration only and includes all modifications or improvements which fall within the scope of the appended claims.

I claim:

1. In a designated parking area, an alarm system including an alarm circuit comprising a vehicle actuatable switch in said area actuatable by a vehicle parked in the area, a coin-operated switch and a key-operated switch, means operable by the activated vehicle switch to condition the coin-operated switch for operation, means operable by the deposit of a coin in the coin switch to release the key from the key-operated switch, alarm means, means operable by removal of the key from the key-operable switch to condition the alarm means for operation, and means operable by deactivation of the vehicle actuated switch in the absence of the key in the key switch to effect actuation of the alarm.

2. An alarm system according to claim 1 wherein restoration of the key to the key-operated switch while the vehicle-actuated switch remains activated disables the alarm means.

3. An alarm system according to claim 1 wherein removal of the key from the key switch effects illumination of an "Alarm Activated" light.

4. An alarm system according to claim 1 wherein there is an "Insert Coin" light which is illuminated by actuation of the vehicle-actuated switch and means operable by removal of the key from the key-operated switch operable to extinguish the "Insert Coin" light.

5. An alarm system according to claim 1 wherein said alarm means comprises visible and audible components.

6. An alarm system according to claim 1 wherein there is means operable by restoring the key to the key-operated switch for deactivating the vehicle-actuated switch.

7. An alarm system according to claim 1 wherein there are normally closed contacts which connect the alarm means in the alarm circuit which are opened by activation of the vehicle-actuatable switch and normally open contacts in the alarm circuit which are closed by removal of the key from the key-operated switch.

8. An alarm circuit according to claim 7 wherein there is a normally closed contact in said alarm circuit and a relay operable by activation of the vehicle-actuatable switch to open the normally closed contact, said relay being operable by deactivation of the vehicle-actuated switch to close said normally closed contact.

9. An alarm system according to claim 1 wherein the vehicle-actuable switch is a road switch activated by the weight of the vehicle resting on it.

* * * * *